United States Patent [19]

Kinoshita et al.

[11] Patent Number: 5,032,482

[45] Date of Patent: Jul. 16, 1991

[54] CARRIER AND DEVELOPER AND METHOD OF DEVELOPING USING SAME

[75] Inventors: Akino Kinoshita; Atushi Yamaguchi, both of Hyogo, Japan

[73] Assignee: Mita Industrial Co., Ltd., Osaka, Japan

[21] Appl. No.: 518,762

[22] Filed: May 3, 1999

Related U.S. Application Data

[63] Continuation-in-part of Ser. No. 247,539, Sep. 22, 1988, abandoned.

[30] Foreign Application Priority Data

Sep. 24, 1987 [JP] Japan ..... 62-240314

[51] Int. Cl.[5] ..... G03G 9/107; G03G 9/113; G03G 13/09

[52] U.S. Cl. ..... 430/102; 430/106.6; 430/108; 430/111

[58] Field of Search ..... 430/106.6, 108, 111, 430/102; 428/405, 407

[56] References Cited

U.S. PATENT DOCUMENTS

| | | | |
|---|---|---|---|
| 3,926,337 | 12/1975 | O'3 Neill et al. | 324/71.1 X |
| 4,055,684 | 10/1977 | Baltazzi et al. | 430/108 X |
| 4,248,954 | 2/1981 | Datta et al. | 430/108 X |

FOREIGN PATENT DOCUMENTS

| | | | |
|---|---|---|---|
| 58-97057 | 1/1958 | Japan | 430/106.6 |
| 58-108548 | 9/1958 | Japan | 430/106.6 |
| 59-97156 | 3/1959 | Japan | 430/106.6 |
| 60-179749 | 5/1960 | Japan | 430/106.6 |

OTHER PUBLICATIONS

Patent Abstracts of Japan-JP-A-59 228261, 3/59.
Patent Abstracts of Japan-JP-A-61 67041, 6/61.
GB-A-2156536-Publication Date 9/10/85.
GB-A-2173604-Publication Date 10/15/86.

*Primary Examiner*—Roland Martin
*Attorney, Agent, or Firm*—Beveridge, DeGrandi & Weilacher

[57] ABSTRACT

Carrier of a two-component type developer having a carrier core material and an organic polymer coating which results in a 20 to 45% carrier filling rate and dynamic permittivity which satisfies both $Y \geqq -0.05+9$ and $Y \leqq -0.05+13.5$ with Y equal to dynamic permittivity and X equal to the carrier filling rate percentage value. The dynamic permittivity of the carrier is determined with an apparatus which includes an adjustable detector having an electrode in electrical communication with an AC power source by way of a capacitor like gap between the photoreceptor of a developer and the electrode of the detector. A reading device and arithmetic unit are also in electrical communication with the detector and power source to enable determination of the dynamic permittivity of the carrier.

11 Claims, 4 Drawing Sheets

CARRIER AND DEVELOPER AND METHOD OF DEVELOPING USING SAME

CROSS REFERENCE TO RELATED APPLICATION

This application is a continuation-in-part of Ser. No. 07/247,539 filed September 22, 1988, now abandoned, which is incorporated herein by reference.

BACKGROUND OF THE INVENTION

The present invention relates to a carrier of a developer, and more particularly to such a carrier to be used in a two-component type developer for developing an electrostatic latent image as well as a means for determining the dynamic permittivity of the carrier.

Conventionally, there has been widely used an image forming apparatus such as an electrophotographic copying apparatus using a Carlson process. The Carlson process generally includes, as basic (indispensable) steps, the steps of:

charging a photoreceptor by corona discharge or the like:

exposing the uniformly charged photoreceptor to form an electrostatic latent image corresponding to the image of an original;

developing the electrostatic latent image thus formed into a toner image by a developer;

transferring the toner image thus formed on the photoreceptor to a base material such as copying paper;

fixing the toner thus transferred to the base material; and cleaning the toner remaining on the photoreceptor.

A two-component type developer containing toner and a carrier is generally used as a developer in the developing step of the Carlson process.

The carrier used is divided into two groups, i.e., a non-coated carrier such as iron oxide powder, ferrite powder or the like, and a carrier coated with, for example, polyester, a fluorine polymer, or the like. The coated carrier is generally excellent in image characteristics and triboelectrification with the toner. Further, the electric resistance or the like thereof can be easily controlled.

The carrier exerts a great influence in the characteristics of triboelectrification with the toner, as well as the image characteristics such as image reproducibility or the like of half-tone portions and solid portions of an original.

In view of the foregoing, there has been proposed a carrier coated with a high resistance substance containing a substance having a high permittivity (Japanese Publication for Unexamined Patent Application No. 19157/1985).

The carrier disclosed in the publication above-mentioned is advantageously excellent in image reproducibilities of the half-tone portions and the solid portions of an original, since the high-resistance substance such as acrylic resin or the like contains a substance having a high permittivity such as barium titanate or the like.

In the carrier above-mentioned, the coating layer for coating the carrier core material made of iron oxide, ferrite or the like, is made of a high-resistance substance containing a substance having a high permittivity. This results in insufficient mechanical strength of the coating layer. It requires the use of a great amount of resin to enhance the mechanical strength. Further, the image reproducibility of the solid portions is still insufficient and consequently a fog is apt to occur. In particular, when a reproduced image is formed from an original having a stripe pattern containing, for example, solid portions arranged at spatial intervals of about 1 to 3 mm, the rear ends of the solid portions cannot be developed in a faithful manner, producing blurs on the reproduced image.

Thus, there is the problem that the image reproducibility of the solid portions is not sufficient.

SUMMARY OF THE INVENTION

It is an object of the present invention to provide a carrier of the developer in which the coating layer for coating the carrier core material has a sufficient mechanical strength, and which is excellent in image reproducibility with less fog, particularly for solid portions.

The term "carrier filling rate", which is a term coined by the present inventors, is defined in general terms by the percentage ratio of carriers which are within the developing nip and in contact with the photoreceptor over the carriers which would exist in a close-packed filling state on the photoreceptor. The above terminology is explained in greater detail below.

When the carrier filling rate is between 20% to 45%, inclusive, and the dynamic permittivity lies within a range satisfying the following formulas:

$$Y \geqq -0.05X+9 \quad (1)$$

$$Y \leqq -0.05X+13.5 \quad (2)$$

(wherein Y denotes the dynamic permittivity of the carrier and X denotes the carrier filling percentage value); the blurs at the rear ends of the reproduced images, especially stripe pattern images, are prevented. Furthermore, in addition to preventing the formation of blurs, the above noted relationship between dynamic permittivity and carrier filling rate maintains suitable image density and prevents the formation of fog. Hence, excellent reproduced images are obtained even after a large number of reproductions.

Parameters which can influence the carrier filling rate include carrier saturation magnetization, carrier diameter, and the gap between photoreceptor and developing sleeve. Accordingly, when two of the above three parameters are held constant, the carrier filling rate can be adjusted by changing the residual or variable parameter. However, in practice with copy machines, the carrier filling rate is decided by all of the carrier properties and developing conditions.

The carrier, in accordance with the present invention, is a carrier of a two-component type developer for developing an electrostatic latent image which comprises a carrier core material and a polymer coating over the core material. In a preferred embodiment of the present invention, the carrier filling rate is 40% and thus, in accordance with the above formulas, the dynamic permittivity is in the range of 7 ($-0.05X\ 40+9$) to 11.5 ($-0.05X\ 40+13.5$), inclusive.

The polymer coating layer provides the carrier with high mechanical strength. Also, the coating layer is of a substance which is relatively low in permittivity such that the carrier falls within the above described dynamic permittivity range. The characteristics of the carrier triboelectrification with tonor can be properly controlled by changing the coating amount.

In accordance with another aspect of the invention, an apparatus and method for determining the dynamic permittivity of the carrier is provided. The apparatus and method for determining dynamic permittivity enable measurements to be taken of the carrier's permittivity in essentially the working conditions the carrier will be subjected to when being utilized for developing or reproducing images.

The present invention's method for dynamically measuring the permittivity of the carrier, used in the development of an electrostatic image, includes providing a carrying member, to which alternating current is provided, with a predetermined thickness of carrier. The method further includes conveying the carrier on the carrying member into a predetermined gap in existence between the carrying member and a detector. The detector forms an opposite electrode and acts to detect current flowing from the carrying member to the detector.

The method further includes the calculation of dynamic permittivity ($\epsilon$) according to the following formula on the basis of signals received from the detector;

$$\epsilon=(d\times C)/(\delta o\ S)$$

wherein d denotes distance between the carrying member and the detector.

C denotes electrostatic capacity, $\epsilon o$ denotes permittivity in vacuum,

S denotes surface area of detector, and the electrostatic capacity C is represented by the following formula:

$$C=I/(\omega\times V)$$

wherein I denotes value of the current in the case that voltage is 0, $\omega$ is angular frequency, and V is the maximum value of the applied AC voltage.

The method is preferably utilized in the situation where the carrying member of the photoreceptor is a rotating sleeve. Further, the method preferably also includes the use of a detector which is adjustable such that the gap between the carrying member and detector can be increased or reduced.

The present invention also includes an apparatus for measuring the dynamic permittivity of the carrier. The apparatus includes a detector having supporting means which positions the detector a predetermined distance away from a carrying member of a developing machine upon which carriers are supplied at a predetermined thickness. The apparatus further includes an arithmetic unit having means for calculating the dynamic permittivity of the carrier as it moves together with the moveable carrying member.

In a preferred embodiment the apparatus includes a detector having means for adjusting the distance between the carrying member and the detector, an oscillograph in electric communication with the power supply for the electrically charged carrying member, and the detector. A dummy resistor is connected at one end to the line which extends between the oscillograph and the detector and at its other end to a ground. A reading means is also provided for receiving signals from the oscillograph and forwarding them to the arithmetic unit for interpretation of the signals and determining the dynamic permittivity of the carrier coated on the carrying member and positioned within the gap between the detector and the carrying member.

DETAILED DESCRIPTION OF THE INVENTION

Figure 1:
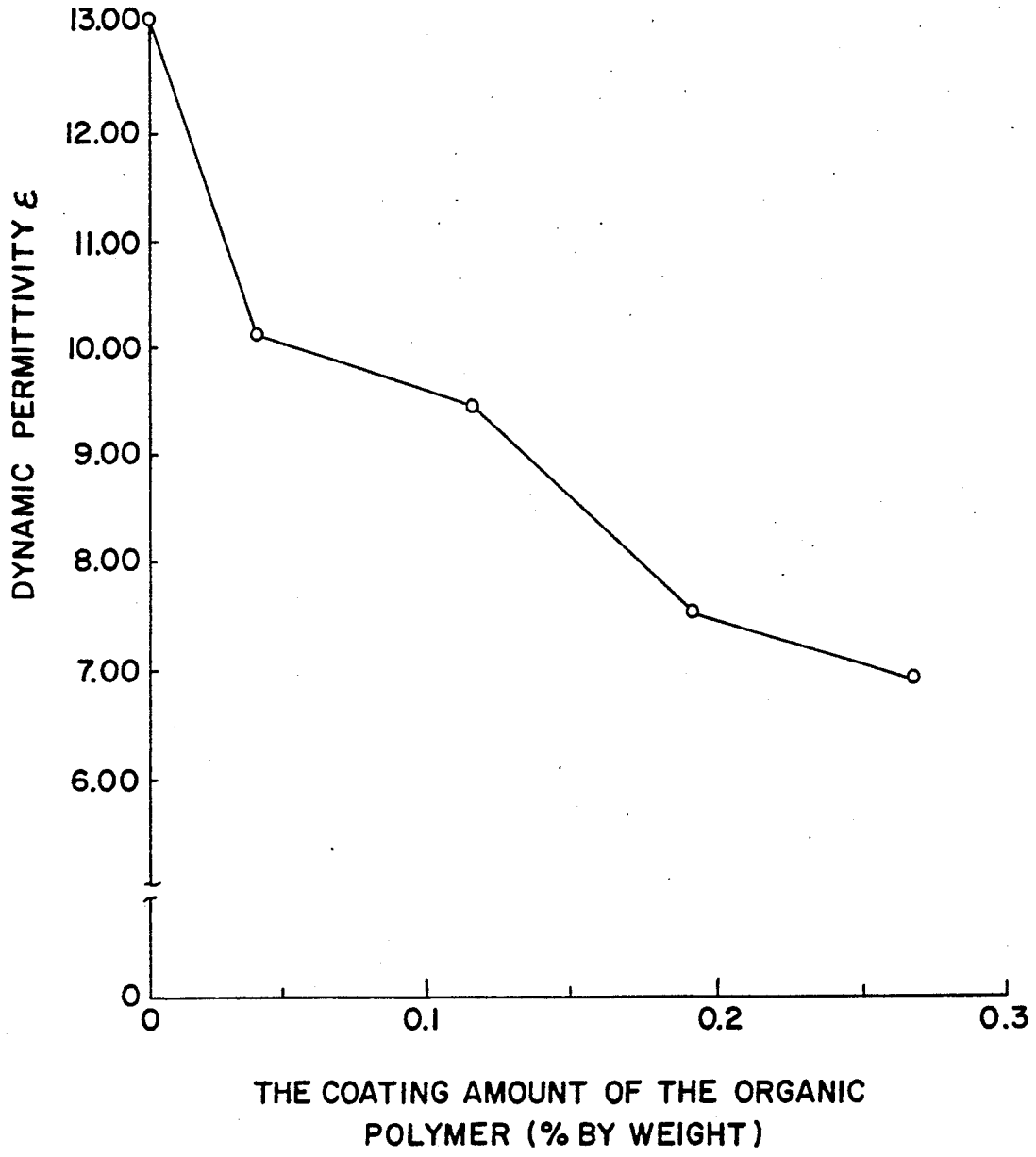
FIG. 1 is a graph showing the relationship between carrier dynamic permittivity and the coating amount of polymer.

The following description will discuss in more detail the present invention.

The carrier of a developer in accordance with the present invention comprises a carrier core material and a polymer for coating the carrier core material.

Examples of the carrier core material include:

- a magnetic substance such as iron oxide, reduced iron, steel, silicon steel, ferrite, nickel, cobalt or the like; and
- an alloy of manganese, zinc, aluminum or the like with the magnetic substance above-mentioned, such as an iron/nickel alloy, an iron/cobalt alloy, an iron/aluminum alloy.

In addition to the above, examples of the carrier core material also include:

- a substance having a high permittivity such as titanium oxide, aluminum oxide, copper oxide, magnesium oxide, lead oxide, zirconium oxide, silicon carbide or the like;
- ceramics such as magnesium titanate, barium titanate, lithium titanate, lead titanate, lead zirconate, lithium niobate or the like;
- ADP ($NH_4H_2PO_4$);
- KDP ($KH_2PO_2$); and
- Rochelle salt.

These examples of the carrier core material may be used independently or in combination of two or more thereof.

Among the examples of the carrier core material above-mentioned, ferrite and iron such as iron oxide and reduced iron are preferable in view of cost and image characteristics.

The carrier core material has a variety of particle sizes, preferably in a range from 20 to 1000 $\mu$m, and more preferably in a range from about 50 to 500 $\mu$m.

With the particle size less than 20 $\mu$m, the flowability of the developer is reduced, causing the carrier 13 to stick to the photoreceptor layer. With the particle size more than 1000 $\mu$m, the tone reproducibility is lowered, causing the reproduced image to be coarse.

In a magnetic brush developing method, the carrier acts as the opposite electrode, causing the toner to be magnetically secured to the magnet. Therefore, the carrier preferably has magnetism or is magnetizable.

The carrier core material has a high permittivity. Accordingly, the permittivity of the carrier can be easily controlled by coating the carrier core material with a polymer having a small permittivity.

A variety of examples of polymers for coating the carrier core material may be selectively used dependent on the amount of the carrier triboelectrification with the toner, the electrification polarity or the like.

Examples of the polymers include:

an acrylic polymer;
a styrene polymer;
a styrene-acrylic copolymer;
an olefin polymer such as polyethylene, chlorinated polyethylene, polypropylene or the like;
polyvinyl chloride;
saturated polyester;
unsaturated polyester;
polyamide;
polyurethane;
epoxy resin;
polycarbonate;
silicone resin;
fluororesin such as polytetrafluoroethylene, polychlorotrifluoroethylene, polyvinylidene fluoride or the like;
ketone resin;
phenol resin;
xylene resin; and
diallyl phthalate resin.

These examples of polymers may be used independently or in combination of two or more thereof.

Among the examples of polymers above-mentioned, the acrylic polymer, the styrene polymer, the styrene-acrylic copolymer, polyester, silicone resin and fluororesin are preferable in view of the characteristics of the carrier triboelectrification with the toner, the mechanical strength and the like.

The carrier of the present invention is found to provide advantageous reproduction qualities when the carrier filling rate is between 20 to 45%, inclusive, and the dynamic permittivity of the carrier lies within a range satisfying the following formulas (1) and (2).

$$Y \geqq -0.05X+9 \quad (1)$$

$$Y \leqq -0.05X+13.5 \quad (2)$$

Wherein Y denotes the dynamic permittivity of the carrier and X denotes the carrier filling rate percentage value. The advantageous reproduction qualities include the reduction or prevention of blurring, the reduction of fog formation, the maintenance of suitable image density, and ease in cleaning of carrier from the carrying member.

Figure 2:
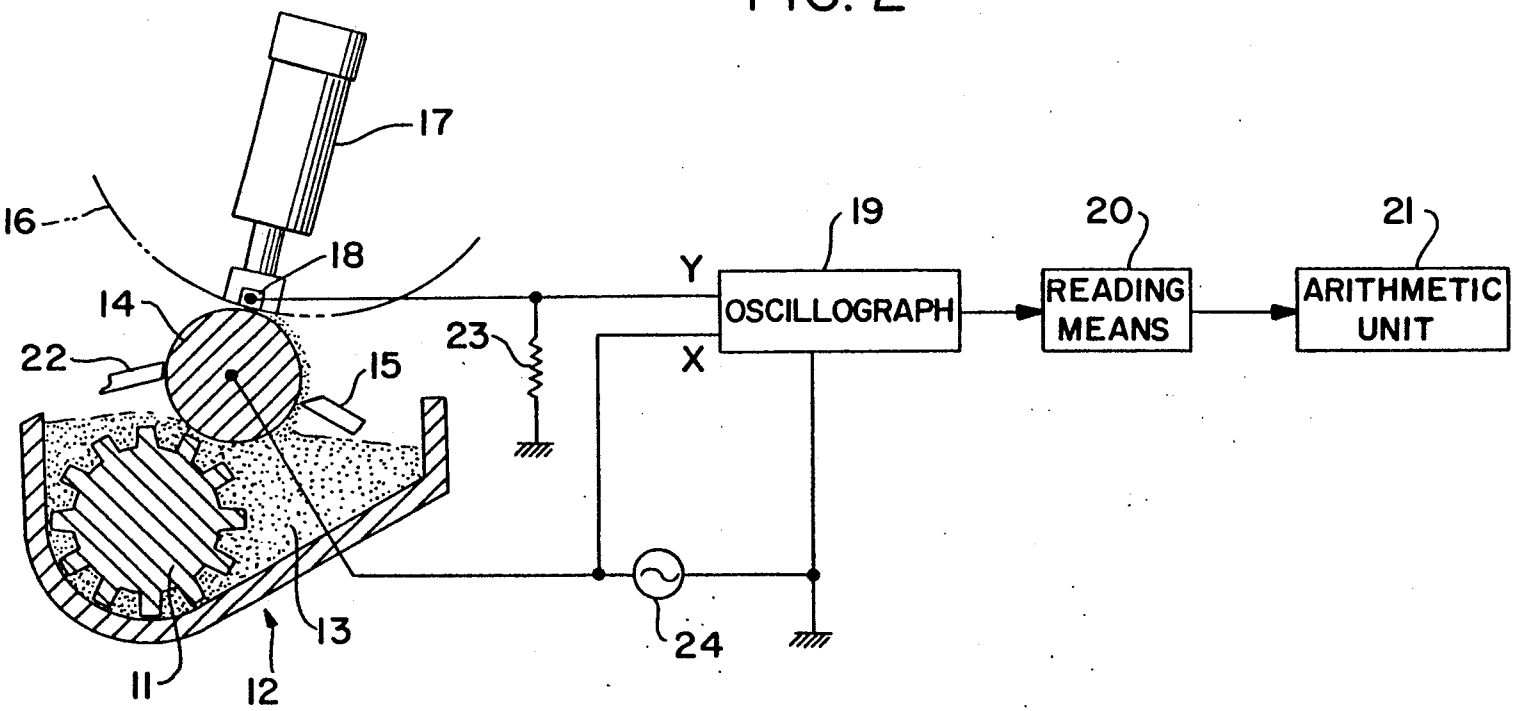
FIG. 2 is a schematic view of one embodiment of the dynamic permittivity measuring means of the present invention.

FIG. 2 shows one type of a developing machine 12 having an agitating roller 11 that houses carrier 13 which is carried onto sleeve 14. The sleeve 14 is rotated to convey the carrier 13 while a carrier layer thickness regulating member 15 regulates the layer thickness of the carrier 13 to maintain a predetermined thickness. A cleaning blade 22 is disposed for removing the carrier 13 remaining on the sleeve 14.

Figure 3:
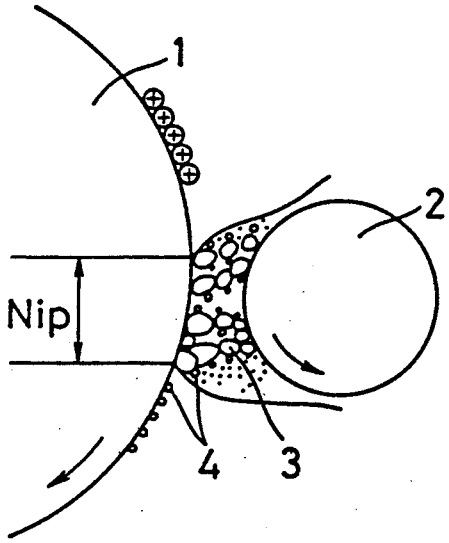
FIG. 3 is an enlarged view for showing a state wherein carriers are contacted with a photoreceptor.

The term "carrier filling rate" means the ratio of the carrier, which is filled in a developing nip and in contact with a photoreceptor, to the carrier which would be in a close-packed filling relationship on the photoreceptor. FIG. 3 shows in greater detail the relationship between the carrier. photoreceptor, and developing sleeve during operation of a developing machine. As shown in FIG. 3, the developing nip is a portion where carrier 3 comes in contact with the photoreceptor 1 in the space between the photoreceptor 1 and developing sleeve 2 and separates a toner 4 so that the toner 4 adheres to the electrostatic latent image on the surface of the photoreceptor 1. The carrier filling rate can be calculated by the following formula:

$$\text{Carrier filling rate} = \frac{\text{Carrier occupation rate}}{\text{Carrier close-packed filling rate}} \times 100$$

Figure 4:
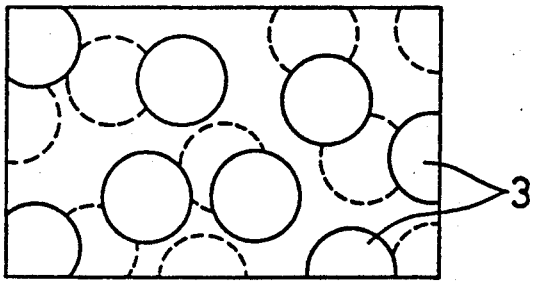
FIG. 4 is an explanatory view showing a method for measuring the carrier filling rate.

As shown in FIG. 4, a carrier occupation rate is a ratio of area that the carrier 3, being in contact with the photoreceptor, occupies per unit area (1 $mm^2$) on the photoreceptor. The carrier occupation rate is calculated as follows:

$$\text{Occupation rate} = \frac{(d/2)^2 \times \pi \times n}{M} \times 100$$

M: predetermined area on the surface of the photoreceptor d: particle diameter of carrier n: number of carrier contacting with the photoreceptor in M. The above "n" is obtained by the following procedure: the carrier is fixed onto the photoreceptor by dropping collodion solution between the photoreceptor and the developing sleeve. Then, a photograph of the carrier 3 being in contact with the photoreceptor is taken with an electron microscope.

Figure 5:
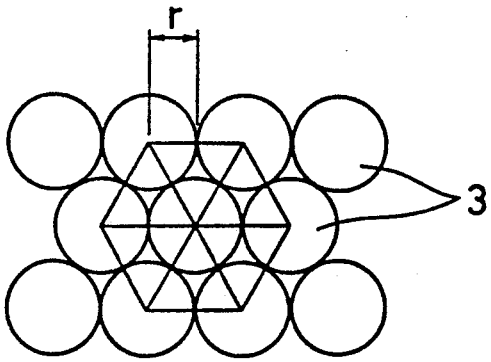
FIG. 5 is an explanatory view showing a close-packed state of carriers.

The carrier close-packed filling rate designates a ratio of area in which spherical-shape carriers are in a close-packed filled arrangement as shown in FIG. 5. Thus, when a radius of the carrier is 1 mm, the carrier close packed filling rate becomes 91% according to the formula below.

$$\frac{3 \times 1^2 \times \pi}{(2 \times 3/\sqrt{2}) \times 6} \times 100 = 91\ (\%)$$

A carrier filling rate fluctuates with the distance between the photoreceptor drum 1 and the developing sleeve 2. On the other hand, when the distance is fixed, it fluctuates with the saturation magnetization of the magnetized carrier. Accordingly, as the saturation magnetization gets larger/smaller, the carrier filling rate becomes larger/smaller.

As discussed above the inventors of the present invention, by development of a unique method for determining the dynamic permittivity of a carrier, have determined that advantageous results are obtained by utilizing a carrier which achieves a carrier filling rate from within 20 to 45% and has a dynamic permittivity value which complies with formulas (1) and (2) set out above. In general, as the permittivity rate increases, a developing electric field is strengthened so that a toner can easily adhere to a photoreceptor. As a result, the toner easily adheres to an electrostatic latent image and the image density increases.

A "carrier filling rate" means, in other words, the frequency of the carrier's contact with the photoreceptor. That is to say, when the photoreceptor has a large carrier filling rate, the absolute amount of the effective carrier which provides the electrostatic latent image with toner also increases. A larger carrier filling rate, however, causes blurs at the rear ends of a solid portion in printing narrow striped patterns.

It is suspected by the inventors that such blurs occur due to the counter charge, which remains on a carrier, acting to scratch off toner adhered to the electrostatic latent image. The suspected phenomenon of toner being scratched off is also believed to be slightly affected by the speed ratio of a developing sleeve to a photoreceptor drum. In reproducing stripe patterns, however, the phenomenon is affected by a developing electric field of an electrostatic latent image and the frequency of the carrier's contact with a photoreceptor.

The present inventors, after having done various studies, have found that in order to get the adequate amount of toner for vivid image density and prevent the toner from being scratched off (especially at the rear end of striped patterns), a permittivity rate of the carrier should be in accordance with formulas (1) and (2) noted previously and the carrier filling rate should be between 20 to 45%. Accordingly, when a carrier filling rate exceeds 45%, the frequency that a carrier is in contact with photoreceptor increases and blurs occur at the rear ends of the striped patterns. On the other hand, when a filling rate becomes less than 20%, the contact frequency decreases so that the amount of the toner adhered to the electrostatic latent image reduces and the image density degrades.

Moreover, with the dynamic permittivity less than that established by the previously noted formula (1), the image density is reduced and it is difficult to faithfully reproduce an image from an original having a stripe pattern. That is, the reproduced image which corresponds to the solid portions of the original is blurred at the rear ends thereof. On the other hand, when the dynamic permittivity exceeds that which is established by the previously noted formula (2) the toner is excessively used for development, resulting in a decrease in toner image transfer efficiency. This not only involves a likelihood of defective cleaning, but also results in the production of fog.

The dynamic permittivity of the carrier may be measured by the use of a permittivity measuring apparatus, one embodiment of which is shown in FIG. 2, and by utilizing the method outlined below.

As shown in FIG. 2, and as previously discussed, a developing machine 12, having an agitating roller 11, houses a carrier 13 which is carried onto a sleeve 14. The sleeve 14 is rotated to convey carrier 13 while a carrier layer thickness regulating member 15 regulates the layer thickness of the carrier 13 to maintain a predetermined thickness. A cleaning blade 22 is disposed for removing the carrier 13 remaining on the sleeve 14. A detector 18 is provided with a micrometer 17. The detector functions as an electrode and is spaced from the sleeve. Micrometer 17 functions as a between-electrodes distance adjusting means and detector 18, which has a predetermined surface area, is disposed opposite to and at a predetermined distance apart from sleeve 14. Accordingly, the detector 18 is disposed along the imaginary line 16 on the surface of a photoreceptor. An AC voltage having a predetermined frequency is applied to the sleeve 14. A dummy resistance 23 and an oscillograph 19 are connected to the output terminal of the detector 18. An AC power supply 24 is disposed in parallel to the sleeve 14 and the oscillograph 19. A voltage (y) proportional to the current flowing in the detector 18 is generated at the dummy resistance 23. The voltage (y) is detected by the oscillograph 19. Wave-form data appearing on the oscillograph 19 is read by reading means 20 such as a sample hold circuit or the like.

In other words, it can be considered that a carrier layer is equivalent to a parallel equivalent circuit of a resistance and a condenser. When AC voltage is applied to the sleeve, current, which flows to the counter electrode forming part of detector 18 and in the position of the photoreceptor, is introduced into the oscillograph. The wave form produced by the oscillograph is transferred to the arithmetic unit to calculate permittivity.

The apparatus of FIG. 2 can be made by rather elementary modifications to a commercially available copying machine. For example, in the comparative tests discussed below, a copying machine manufactured by Mita Industrial Co., Ltd. as the "DC-111" model was relied upon. The DC-111 model has a 28 mm sleeve diameter and a sleeve rotating velocity of 200 rpm.

AC signal source or power supply 24 is preferably a function generator with a voltage of about 20 V such as the "LFG-3000" function generator manufactured by Leader Electronics Corp.

In order to remove high-frequency noise of about 600 Hz or more from the electrical system shown in FIG. 2, a low-pass filter circuit is provided. Also, it is preferable that permittivity measurements are taken at or less than 60 Hz (e.g., 50 Hz).

A suitable oscillograph to which current is fed from the opposite electrode (i.e., detector 18) is a digital oscillograph such as the "Sony Techtoro 336" manufactured by Sony Ltd. The digital oscillograph also preferably carries out 128 averagings to remove factors such as an off-centered sleeve, sleeve rotation irregularities, low frequency noise and the like.

The wave form obtained in the oscillograph is preferably, transferred to a controller or arithmetic unit for determination of the dynamic permittively and displaying or printing the value. A suitable device for the purposes of the present invention includes the "CONTROLLER 9826" manufactured by Hewlett Packard Ltd.

Based on the data thus read, the dynamic permittivity is calculated by the arithmetic unit or controller 21 according to the following equation:

$$C=I/(w\times V)$$
$$\epsilon=(d\times C/(\epsilon\times S)$$

where

C: Electrostatic capacity

I: Maximum value of the current flowing in the detector 18 which is calculated with the use of the resistance value of the dummy resistance 23

$\omega$: Angular frequency of the AC voltage

V: Maximum value of the AC voltage applied across the sleeve 14 and the detector 18, which is substantially equal to the maximum voltage value of the AC power supply 24.

$\epsilon$: Dynamic permittivity $\epsilon o$ : Permittivity in vacuum d: Distance between the electrodes S: Electrode area.

Based on a detection signal y from the detector 18 and the original signal x, the permittivity measuring apparatus can also calculate the carrier resistance R, the resistivity $\rho$ and the relaxation time $\tau$ at the arithmetic unit 21 according to the following equation:

$$R = \tan\psi \times (V/I)$$

$$\rho\ (\text{ohms/cm}) = R \times (S/d)$$

$$\tau = \tan\psi/w$$

Where $\psi$: Phase difference between the voltage and the current appearing on the oscillograph 19.

Among the component elements of the measuring apparatus above-mentioned, although providing improved readings, the agitating roller 11, the dummy resistance 23 and the oscillograph 19 as a monitor are not necessarily required, and in that case, a signal from the detector 18 is supplied directly to the reading means 20.

The carrying member for carrying the carrier of a developer is not limited to the sleeve, but may be in the form of a sheet. When the carrying member in the form of a sheet is used, the carrier of a developer is carried by moving the carrying member straight on at a predetermined speed.

Provision may be made such that the dynamic permittivity calculated at the arithmetic unit 21 is printed out.

An advantageous feature of the present invention is that the carrier permittivity properties can be automatically measured on a developing sleeve under the same developing conditions as in a practical copying machine. Also, the rotating velocity of the sleeve, the carrier layer thickness, and the distance between the sleeve and detector can be varied so as to conform to the arrangements of commercially available copying machines. The versatility enables the production of a carrier specifically suited to the characteristics of a commercial copying machine.

The preferred carrier dynamic permittivity range of 7 to 11.5 discussed above and obtained under the measuring conditions above-mentioned corresponds to the static permittivity of about 9 to 17 at a time when static measurement is made according to a conventional method.

According to the method of measuring the dynamic permittivity above-mentioned, the characteristics of the permittivity or the like can be measured under the conditions in conformity with the actual developing process, unlike the method of measuring the static permittivity. Accordingly, the characteristics of the carrier of a developer can be evaluated in conformity with the actual developing process. In particular, when a developing sleeve incorporating a magnet is used as the sleeve 14, a magnetic carrier such as iron powder commercially available as the carrier of a developer, may be magnetically carried. This allows for an evaluation of the carrier characteristics which is in greater conformity with the actual developing process. Thus, the permittivity measuring apparatus above-mentioned is also advantageous in view of evaluation of the characteristics of the toner.

The carrier permittivity may be controlled by adjusting the coating amount of polymer. The coating amount of polymer may be variously set dependent on the types of the carrier core material and the polymer used.

Preferably, the coating amount of polymer is in a range from 0.01 to 0.5% by weight of the amount of the carrier core material, and more preferably in a range from 0.01 to 0.25% by weight. With the coating amount of the polymer less than 0.01% by weight, it is difficult to uniformly coat the carrier core material to enhance the mechanical strength of the coating layer. It is also difficult to control the carrier permittivity below 11.5 when the carrier filling rate is, for example, 40%.

On the other hand, when the coating amount exceeds 0.5% by weight, it is not only expensive, but also causes restrictions imposed on the selection of the carrier core material, making it difficult to control the carrier permittivity to 7 or more when the carrier filling rate is, for example, 40%.

The carrier in accordance with the present invention may be produced by any of various conventional methods, examples of which include;

a fluidization coating method in which the polymer is dissolved in a solvent to prepare a polymer solution, which is then sprayed to a carrier core material and the solution thus sprayed is allowed to dry; and a method in which the carrier core material is immersed in the polymer solution and then allowed to dry.

In the fluidization coating method above-mentioned air is supplied form the underpart of a coating device of the fluidized bed type, causing the carrier core material to float in a flowing condition, and a predetermined amount of the polymer solution is sprayed from the upper part of the coating device to coat the carrier core material and the solution thus sprayed is then allowed to dry.

The coating amount of the polymer for coating the carrier core material may be controlled by adjusting the amount of the polymer solution and the concentration of the polymer.

A variety of examples of the solvent to be used for preparing the polymer solution may be selectively used dependent on the type of polymer used.

Examples of the solvent include:

alcohols such as methanol, ethanol, propanol, isopropanol or the like:

aliphatic hydrocarbon such as n-hexane, octane, cyclohexane or the like;

aromatic hydrocarbon such as benzene, toluene, xylene or the like;

halogenated hydrocarbon such as dichloromethane, dichloroethane, carbon tetrachloride, chlorobenzene or the like;

ethers such as dimethyl ether, diethyl ether, tetrahydrofuran, ethylene glycol, dimethyl ether or the like;

ketones such as acetone, methyl ethyl ketone, cyclohexanone; and esters such as ethyl acetate, methyl acetate or the like.

These examples above-mentioned may be used independently or in combination of two or more thereof.

The carrier of a developer-above mentioned is used together with toner. The toner includes a coloring agent such as carbon black or the like, binding resin such as a styleneacrylic copolymer, an electric charge control agent and the like, and has a particle size in a range from about 5 to 20 $\mu$m. The toner may be used in a variety of concentrations, but may generally be used in a concentration from 2 to 10% by weight.

The carrier of a developer comprises a carrier core material and a polymer for coating the carrier core material. It is therefore possible to properly control the characteristics of the carrier triboelectrification with the toner, by properly setting the coating amount.

Further, the mechanical strength of the coating layer for coating the carrier core material is not lowered.

Since the carrier dynamic permittivity is in a range of $Y \geqq -0.05X+9$ to $Y \leqq -0.05X+13.5$ wherein Y denotes the dynamic permittivity of the carrier and X denotes the carrier filling rate, an electrostatic latent image formed on the photoreceptor can be faithfully developed. More specifically, the carrier of the present invention is excellent in image reproducibilities of fine-line portions, half-tone portions, solid portions and the like of an original. Accordingly, even though the original has a stripe pattern, an image may be clearly reproduced without generating neither fog or blurs at the rear ends of the solid portions.

Thus, the carrier of a developer may be suitably used as a carrier of a two-component type developer for developing an electrostatic latent image by a cascade developing method or a magnetic brush developing method, the electrostatic latent image being formed on a photoreceptor, in particular an organic photoreceptor and more particularly a photoreceptor for positive electrification, used in an electrophotographic copying apparatus, a facsimile or a laser printer.

The following description discusses in detail examples of the present invention.

Examples 1 to 3 and comparative examples 1 and 2

Preparation of Carrier Examples of Developer 3 kgs. of ferrite having an average particle size of 150 μm (manufactured by Nippon Teppun Company) and representing the carrier core material, was coated with a silicone resin solution composed of 40 grs. of silicone resin (tradename KR-255 manufactured by Shinetsu Silicone Company) and 1960 grs. of methyl ethyl ketone, by a fluidization coating method. More specifically, the ferrite was put in a coating apparatus of the fluidized bed type, and air was then supplied from the underpart of the coating apparatus, causing the ferrite to float in a flowing condition. A predetermined amount of the silicone resin solution was sprayed from the upper part of the coating apparatus, thus producing a carrier in which the ferrite as a carrier core material is coated with the silicone resin.

By employing various amounts of the silicone resin solution in the foregoing steps, 3 types of examples of the carrier were made where the coating amount of the silicone resin is respectively 0.038% by weight of the amount of the carrier core material (Example 1), 0.114% by weight (Example 2) and 0.190% by weight (Example 3).

The dynamic permittivity of each carrier thus prepared was measured with the use of the apparatus shown in FIG. 2. In this case, the distance between the sleeve 14 and the detector 18, i.e. the distance between electrodes, was adjusted within the range 0.8 to 1.6 mm. The rotating velocity of sleeve 14 was varied within the range of 150 to 250 rpm. Other conditions are as follows:

| | |
|---|---|
| Surface area of the detector 18, i.e. electrode areas | 0.785 $dcm^2$ |
| Frequency of the AC voltage | 50 Hz |
| Layer thickness of the carrier 13 carried by the sleeve 14 (to be adjusted by the carrier layer thickness regulating member 15) | 1.0 mm |

Preparation of Developer and Imaqe Formation

There were prepared two-component type developers each of which is composed of 95.5 parts by weight of each of the carrier examples above-mentioned and 4.5 parts by weight of toner having the average particle size of about 10 μm. Each developer was housed in an electrophotographic copying apparatus provided with an organic photoreceptor (Improved DC-111 Type manufactured by Mita Industrial Co., Ltd.). An original having a stripe pattern which has a plurality of about 5 mm-width lines at about 1.5 mm spatial intervals was respectively reproduced with the use of each developer.

Examples 4 to 16 and Comparative Examples 1 to 8

Each of carriers was prepared by the same manner as Example 3 except that the polymer for coating was coated on the carrier core material under the conditions shown in Table 1.

In Table 1, PMMA and St-A mean polymethyl methacrylate and styrene-acrylic resin, respectively.

FIG. 1 is a graph showing the relationship between the dynamic permittivity of Examples 1 to 3 and Comparative Examples 5 to 6, and the coating amount of the silicone resin with the dynamic permittivity plotted as ordinate and the coating amount (% by weight) plotted by abscissa.

As apparent from FIG. 1, the greater the coating amount of the polymer is, the smaller the dynamic permittivity of the carrier is.

TABLE 1

| Example No. | Carrier core material | Diameter of carrier core material (μm) | Polymer for coating | Coating amount (wt. %) |
|---|---|---|---|---|
| 1 | ferrite | 150 | silicone | 0.038 |
| 2 | ferrite | 150 | silicone | 0.114 |
| 3 | ferrite | 150 | silicone | 0.190 |
| 4 | ferrite | 150 | PMMA | 0.050 |
| 5 | iron oxide | 100 | silicone | 0.114 |
| 6 | iron oxide | 100 | silicone | 0.038 |
| 7 | ferrite | 100 | ST-A | 0.023 |
| 8 | ferrite | 100 | ST-A | 0.185 |
| 9 | ferrite | 80 | silicone | 0.015 |
| 10 | ferrite | 90 | silicone | 0.014 |
| 11 | ferrite | 100 | silicone | 0.175 |
| 12 | ferrite | 120 | silicone | 0.093 |
| 13 | ferrite | 100 | silicone | 0.185 |
| 14 | ferrite | 70 | ST-A | 0.020 |
| 15 | ferrite | 95 | ST-A | 0.160 |
| 16 | ferrite | 95 | ST-A | 0.190 |
| Com. Ex. 1 | ferrite | 80 | silicone | 0.110 |
| Com. Ex. 2 | ferrite | 80 | silicone | 0.013 |
| Com. Ex. 3 | ferrite | 95 | PMMA | 0.201 |
| Com. Ex. 4 | ferrite | 100 | PMMA | 0.012 |
| Com. Ex. 5 | ferrite | 150 | silicone | 0.266 |
| Com. Ex. 6 | ferrite | 150 | none | 0.000 |
| Com. Ex. 7 | ferrite | 80 | silicone | 0.018 |
| Com. Ex. 8 | ferrite | 100 | ST-A | 0.113 |

Saturation magnetization, filling rate and dynamic permittivity of each of the carriers was measured. Furthermore, likewise Example 1, preparing developers with carriers obtained from Examples 4 to 16 and Comparative Examples 1 to 8, reproduced images were formed.

The reproduced images thus obtained were checked for the image density of the solid portions, the degree of fog and the degree of blurs at the rear ends of reproduced images corresponding to the stripe patterns in 80,000 continuous reproductions. That is, the image density of the solid portions and the degree of fog were evaluated by the reflection density which is obtained from the measurement by the reflection densitometer "Model TC-6D" manufactured by Nippon Denshoku Co.. Ltd. The degree of blurs at the rear ends of reproduced images was evaluated by the following manners.

○: no blur

Δ: Some blurs

Figure 6:
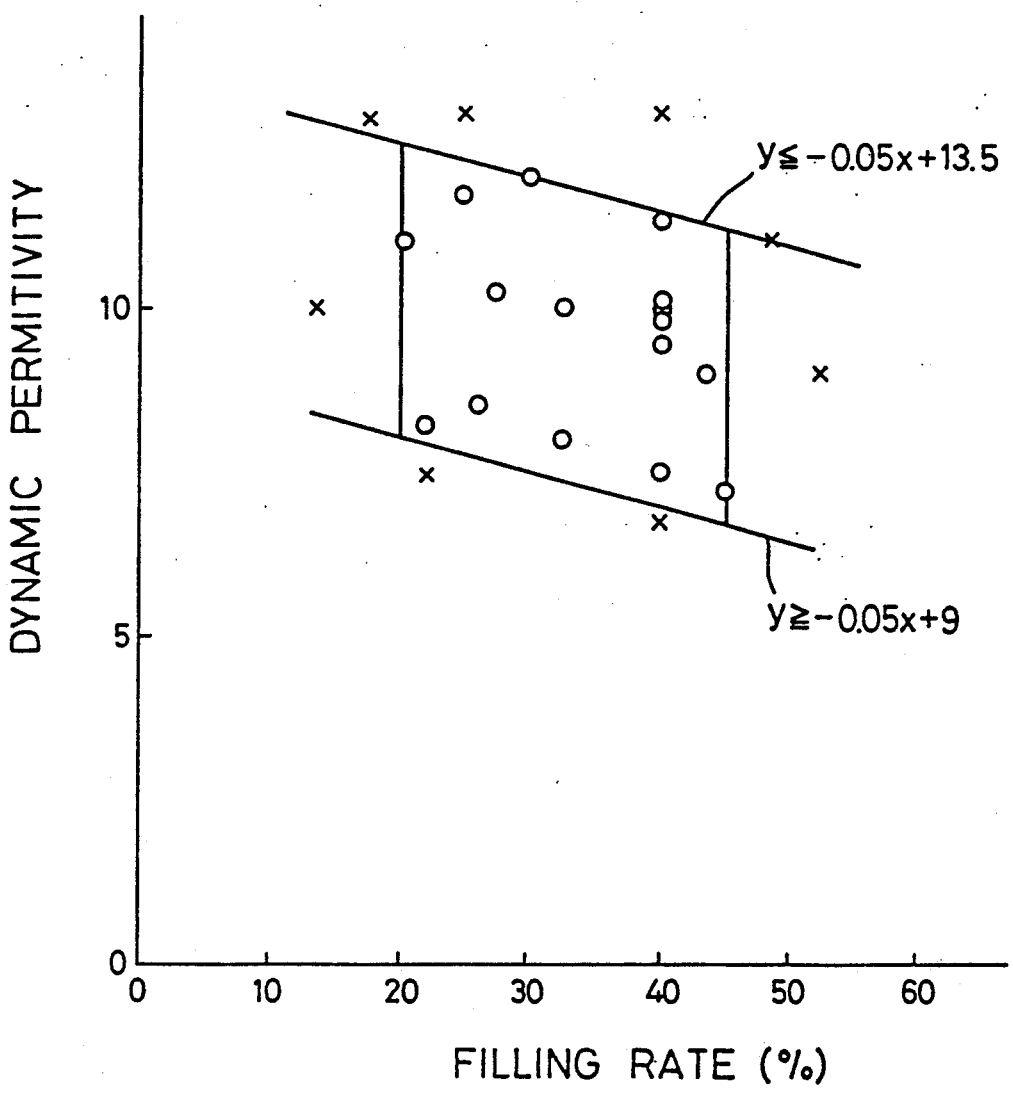
FIG. 6 is a graph showing the relation between carrier filling rate and dynamic permittivity.

X : Many blurs The results obtained are shown in Table 2. Also, the relation between the filling rate and the dynamic permittivity is shown in FIG. 6, in which ○ and X mean Examples and Comparative Examples, respectively.

TABLE 2

| Example | Saturation magnetization (emu/g) | Filling rate (%) | Dynamic permittivity |
|---|---|---|---|
| 1 | 65 | 40 | 10.1 |
| 2 | 65 | 40 | 9.4 |
| 3 | 65 | 40 | 7.5 |
| 4 | 65 | 40 | 9.8 |
| 5 | 72 | 40 | 10.0 |
| 6 | 72 | 40 | 11.3 |
| 7 | 55 | 22 | 8.2 |
| 8 | 55 | 20 | 11.0 |
| 9 | 48 | 25 | 11.8 |
| 10 | 52 | 27.5 | 10.3 |
| 11 | 46 | 26 | 8.6 |
| 12 | 48 | 33 | 10.0 |
| 13 | 48 | 33 | 8.0 |
| 14 | 46 | 30 | 11.9 |
| 15 | 55 | 44 | 9.0 |
| 16 | 55 | 45 | 7.3 |

| Example | Image density of the solid portion | Fog density | Blurs in stripe pattern images |
|---|---|---|---|
| 1 | 1.48 | 0.003 | 0 |
| 2 | 1.43 | 0.001 | 0 |
| 3 | 1.29 | 0.002 | 0 |
| 4 | 1.41 | 0.003 | 0 |
| 5 | 1.47 | 0.004 | 0 |
| 6 | 1.48 | 0.004 | 0 |
| 7 | 1.39 | 0.001 | 0 |
| 8 | 1.44 | 0.004 | 0 |
| 9 | 1.38 | 0.002 | 0 |
| 10 | 1.40 | 0.001 | 0 |
| 11 | 1.32 | 0.001 | 0 |
| 12 | 1.38 | 0.003 | 0 |
| 13 | 1.35 | 0.001 | 0 |
| 14 | 1.48 | 0.006 | 0 |
| 15 | 1.39 | 0.001 | Δ |
| 16 | 1.35 | 0.001 | Δ |

| Example | Saturation magnetization (emu/g) | Filling rate (%) | Dynamic permittivity |
|---|---|---|---|
| Com. Ex. 1 | 64 | 14 | 10.0 |
| Com. Ex. 2 | 64 | 17 | 12.9 |
| Com. Ex. 3 | 45 | 22 | 7.5 |
| Com. Ex. 4 | 55 | 25 | 13.0 |
| Com. Ex. 5 | 65 | 40 | 6.9 |
| Com. Ex. 6 | 65 | 40 | 13.0 |
| Com. Ex. 7 | 62 | 48 | 11.0 |
| Com. Ex. 8 | 52 | 52 | 9.0 |

| Example | Image density of the solid portion | Fog density | Blurs in stripe pattern images |
|---|---|---|---|
| Com. Ex. 1 | 1.04 | 0.001 | — |
| Com. Ex. 2 | 1.33 | 0.013 | 0 |
| Com. Ex. 3 | 1.19 | 0.001 | — |
| Com. Ex. 4 | 1.43 | 0.023 | 0 |
| Com. Ex. 5 | 1.18 | 0.001 | — |
| Com. Ex. 6 | 1.49 | 0.032 | — |
| Com. Ex. 7 | 1.44 | 0.006 | x |
| Com. Ex. 8 | 1.41 | 0.003 | x |

As apparent from Table 2 and FIG. 6, when the filling rate (X) is in the range of 20 to 45% and the dynamic permittivity (Y) is in the range between the formulas (1) and (2), the reproduced images are clear without generating fog or blurs.

On the other hand, for the Comparative Examples 1, 3 and 5, very low density of the solid portions is recognized and therefore blurs at the rear ends of stripe patterns cannot be evaluated. In Comparative Examples 2, 4 and 6, high fogs are recognized, and in Comparative Examples 7 and 8, many blurs at the rear ends are recognized.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A carrier for developing an electrostatic latent image, comprising a carrier core material and a polymer coating over said carrier core material, said carrier being formed so as to have a determined dynamic permittivity (Y) being in a range which satisfies both of the following formulas:

$$Y \geqq -0.05\,X+9$$

$$Y \leqq -0.05\,X+13.5$$

wherein X denotes the carrier filling rate, and said carrier being formed so as to achieve a carrier filling rate of 20 to 45%.

2. A carrier according to claim 1, wherein the polymer is silicone resin.

3. A carrier according to claim 1, wherein the coating amount of the polymer is in a range from 0.01 to 0.5% by weight of the amount of the carrier core material.

4. A carrier according to claim 1, wherein the carrier core material has a grain size in a range from 20 to 1000 μm.

5. A carrier according to claim 1, wherein the carrier core material is made of at least one material selected from the group consisting of: iron oxide; reduced iron; steel; silicon steel; ferrite; nickel; cobalt; an alloy or iron oxide, reduced iron, steel, silicon steel, ferrite, nickel or cobalt with manganese, zinc or aluminum; titanium oxide; aluminum oxide: copper oxide; magnesium oxide; lead oxide; zirconium oxide; silicon carbide; magnesium titanate; barium titanate; lithium titanate; lead titanate; lead zirconate; lithium niobate; ADP ($NH_4H_2PO_4$); KDP($KH_2PO_4$); and Rochelle salt.

6. A carrier according to claim 1, wherein the carrier achieves a carrier filling rate of about 40% and the dynamic permittivity is within the range of 7 to 11.5.

7. A method for measuring dynamic permittivity of a carrier of a two-component type developer, comprising:

supplying the carrier, at a predetermined thickness, onto a surface of a carrying member to which alternating current (AC) is applied;

conveying the carrier supplied to the carrying member into a gap positioned between the carrying member and a detector which acts as an opposite electrode so as to detect a current flowing form the carrying member to the detector; and calculating dynamic permittivity (ε) of the carrier according to the following formula on the basis of signals received from the detector, $$\epsilon=(d\times C)/(\epsilon o\times S)$$

wherein d denotes the distance between the carrying member and the detector,

C denotes electrostatic capacity between said carrying member and said detector, εo denotes permittivity in vacuum, S denotes the surface area of the detector, and the electrostatic capacity C is represented by the following formula:

$$C=I/(\omega\times V)$$

wherein I denotes the value of the current in the case that voltage is 0, $\omega$ is angular frequency, of the alternating current and V is the maximum value of the applied AC voltage.

8. A carrier according to claim 1 wherein the carrier core material has a particle size of 50 to 500 $\mu$m.

9. A carrier according to claim 8 wherein the coating amount of polymer coating is about 0.01 to 0.25% by weight of carrier.

10. A carrier according to claim 1 wherein the coating amount of polymer coating is about 0.01 to 0.25% by weight of carrier.

11. A method for developing an electrostatic latent image, wherein a magnetic brush comprising a mixture of a toner and a carrier, which is held and conveyed on a developing sleeve, is slidably contacted with the electrostatic latent image on a photoreceptor, the improvement comprising:

contacting the carrier with the photoreceptor, the carrier being formed so as to have a carrier filling rate X of about 20 to 45% with X represented by the following formula (a):

$$X=\frac{\text{Carrier occupation rate}}{\text{Carrier close-packed filling rate}}\times 100 \quad \text{(a)}$$

in a developing nip where the photoreceptor and the magnetic brush are contacted to each other; and a dynamic permittivity Y of the carrier, which is calculated by the following formula (b):

$$Y=(d\times C)/(\epsilon o\times S) \quad \text{(b)}$$

wherein d denotes distance between the carrying member and the detector.

C denotes electrostatic capacity, $\epsilon o$ denotes permittivity in vacuum, and S denotes surface area of detector, and the electrostatic capacity C is represented by the following formula:

$$C=I/(w\times V)$$

wherein I denotes value of the current in the case that voltage is zero, w is angular frequency, and V is the maximum value of the applied AC voltage, and wherein dynamic permittivity Y satisfies both equation (c) and (d):

$$Y\geqq -0.05X+9 \quad \text{(c)}$$

$$Y\leqq -0.05X+13.5 \quad \text{(d).}$$

* * * * *

UNITED STATES PATENT AND TRADEMARK OFFICE

CERTIFICATE OF CORRECTION

PATENT NO. : 5,032,482

DATED : July 16, 1991

INVENTOR(S) : KINOSHITA et al.

It is certified that error appears in the above-identified patent and that said Letters Patent is hereby corrected as shown below:

On the title page, item [22], after "Filed:"
replace "May 3, 1999" with --May 3, 1990--.

Signed and Sealed this

Nineteenth Day of January, 1993

*Attest:*

DOUGLAS B. COMER

*Attesting Officer*

*Acting Commissioner of Patents and Trademarks*